US007053846B2

(12) United States Patent
Parsche

(10) Patent No.: US 7,053,846 B2
(45) Date of Patent: May 30, 2006

(54) SPHERICAL RING ANTENNA

(75) Inventor: Francis Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 176 days.

(21) Appl. No.: 10/694,148

(22) Filed: Oct. 27, 2003

(65) Prior Publication Data

US 2005/0088352 A1 Apr. 28, 2005

(51) Int. Cl.
*H01Q 9/00* (2006.01)

(52) U.S. Cl. ..... 343/749; 343/744

(58) Field of Classification Search ..... 343/741, 343/744, 748, 749, 788, 866
See application file for complete search history.

(56) References Cited

U.S. PATENT DOCUMENTS

| | | | | |
|---|---|---|---|---|
| 3,230,536 A | | 1/1966 | Cheston | 343/754 |
| 3,665,479 A | | 5/1972 | Silliman | 343/726 |
| 4,185,289 A | | 1/1980 | DeSantis et al. | 343/770 |
| 5,014,070 A | * | 5/1991 | Stock et al. | 343/700 MS |
| 5,218,372 A | | 6/1993 | Cheng | 343/749 |
| 5,459,475 A | | 10/1995 | Shen et al. | 343/781 |
| 5,530,453 A | * | 6/1996 | Koyama | 343/718 |
| H1571 H | * | 8/1996 | Hansen et al. | 343/728 |
| 6,597,318 B1 | | 7/2003 | Parsche et al. | 343/700 |
| 6,600,451 B1 | * | 7/2003 | Mimura et al. | 343/741 |
| 6,812,902 B1 | * | 11/2004 | Rossman et al. | 343/725 |

OTHER PUBLICATIONS

"Model 6602 Horizontally-Polarized FM Antenna, Full-Wave-Spaced," Shively Labs, Technical Brochure, 2 pages.
"Model 6602 Horizontally-Polarized FM Antenna, Half-Wave-Spaced," Shively Labs, Technical Brochure, 2 pages.
"Model 6600 Horizontally-Polarized FM Antenna, Full-Wave-Spaced," Shively Labs, Technical Brochure, 2 pages.
"Model 6600 Horizontally-Polarized FM Antenna, Half-Wave-Spaced," Shively Labs, Technical Brochure, 2 pages.
"Low Power Educational FM Antenna," Electronics Research, Inc., Technical Brochure, 1 page.
"Low Power FM Antenna 100 Series," Electronics Research, Inc., Technical Brochure, 2 pages.
"1105 Series FM Antenna," Electronics Research, Inc., Technical Brochure, 2 pages.
"SHP-H Series FM Antenna Horizontal Polarization," Electronics Research, Inc., Technical Brochure, 2 pages.

(Continued)

*Primary Examiner*—Shih-Chao Chen
(74) *Attorney, Agent, or Firm*—Allen, Dyer, Doppelt, Milbrath & Gilchrist, P.A.

(57) ABSTRACT

An antenna includes a radiating ring element formed as a spherical sector or about a one-half wavelength circumference in natural resonance for obtaining uniform current distribution and enhancing the gain relative to the size of the antenna. A capacitive element, such as a gap, can be formed therein for forcing the radiating ring element to resonance. A variometer feeds the radiating ring element and is operative for varying feed impedance.

29 Claims, 2 Drawing Sheets

OTHER PUBLICATIONS

"Multiplexing With a Side Mount Antenna," Electronics Research, Inc., Technical Brochure, 2 pages.
"SHPX Series FM Antenna," Electronics Research, Inc., Technical Brochure, 2 pages.
"MPX Series FM Antenna," Electronics Research, Inc., Technical Brochure, 2 pages.
"LPX Series FM Antenna," Electronics Research, Inc., Technical Brochure, 2 pages.
"Low & Medium Power UHF Antennas for DTV and NTSC," Dielectric Communications, Technical Brochure, 6 pages.
"DCR-L Low Power FM Broadcast Antenna," Dielectric Communications, Technical Brochure, 2 pages.
"DCR-M Series-Quadrapole Antenna," Dielectric Communications, Technical Brochure, 2 pages.
"DCR-C Series," Dielectric Communications, Technical Brochure, 2 pages.
"DCR-H Series-Medium Power," Dielectric Communications, Technical Brochure, 2 pages.
"DCR-Q Broadband FM Antenna," Dielectric Communications, Technical Brochure, 4 pages.
"HDR Series Interleaved FM Array," Dielectric Communications, Technical Brochure, 3 pages.
"TLS-V Series High Band VHF Antenna," Dielectric Communications, Technical Brochure, 1 page.

* cited by examiner

SPHERICAL RING ANTENNA

FIELD OF THE INVENTION

This invention relates to the field of antennas, and more particularly, this invention relates to electrically small antennas, and to a radiating antenna element that is configured to give the greatest possible efficiency and gain relative to size.

BACKGROUND OF THE INVENTION

Newer designs and manufacturing techniques have driven electronic components to small dimensions and miniaturized many communication devices and systems. Unfortunately, antennas have sizes that are related to wavelength, and they have not been reduced in size at a commensurate level and they increasingly are one of the largest components used in small communications devices. In Ultra High Frequency and lower communication applications, antennas size becomes increasingly larger. At very low frequencies, for example, used by submarines or other low frequency communication systems, the antennas become very large, which is unacceptable. It becomes increasingly important in these communication applications to reduce not only antenna size, but also to design and manufacture a reduced size antenna having the greatest gain for the smallest size.

In current, everyday communications devices, many different types of patch antennas, loaded whips, copper springs (coils and pancakes) and dipoles are used in a variety of different ways. These antennas, however, are sometimes large and impractical for a specific application.

For years, some antenna designers used Maxwell and Wheeler antenna design theories, and concentrated on using spherical shapes with many loops of coil. These prior art designs were typically based on Maxwell's spherical inductor with a forced resonance using capacitors. An example of such prior art antenna is a three dimensional inductor loop antenna. Other antenna designs stressing a small size have used one-half silver wire dipole, but have been limited to full size, self resonant antenna structures. Two-dimensional antenna designs as inductor/loop antennas have been designed as silver annular rings, but were not practical even though some were small.

Other prior art antenna designers have tried to improve Maxwell's spherical inductor and Wheeler's coil, with forced resonance or variable impedance devices, while maintaining a small antenna design. For example, in the beginning days of radio, the earliest variable ratio transformers used a secondary, larger winding and a mechanism that used another primary winding located inside the larger winding. With this design, the fields aided or opposed each other. In other research and development laboratories, it was believed that the best way to make these and other types of spherical antennas resonant was to add greater turns of wire. Unfortunately, as the turns of wire increased, the additional windings "shaded" the antenna aperture against adjacent turns of the wires and interrupted the field. The cost and operational efficiency of this antenna was reduced. Many of these antennas also did not have a uniform current distribution and had Eddy currents distributed throughout the antenna. Also, with many windings, these prior art spherical antenna had a proximity effect and flux escaped.

Some define this invention to be the smallest possible antenna, as it provides the greatest gain and efficiency in the shortest length, by virtue of a spherical geometry, which provides the greatest surface area for the smallest volume.

SUMMARY OF THE INVENTION

It is therefore an object of the present invention to provide an antenna that has a shape that enhances its gain relative to its size.

It is another aspect of the present invention to provide an antenna that is operative for varying its feed impedance and enhancing its gain relative to its size.

The present invention advantageously provides an improved antenna that has uniform current distribution throughout its structure and enhances its gain relative to its size. The antenna of the present invention could be used for portable, mobile, and personal communications at many different frequencies, and is especially applicable for use at low frequency ranges up to about 6 GHz, where antennas often can be some of the larger components in the overall design. The antenna of the present invention is a spherical antenna having a maximum surface area with minimum volume. It is self-resonating in one aspect of the invention and is efficient compared to prior art Maxwell and Wheeler antenna designs that traded efficiency for size. The antenna of the present invention can have a forced resonance with high efficiency and could include a variometer for changing the feed impedance. It has uniform current distribution with no Eddy currents and no proximity effect. There is no lost conductor surface between currents and no escaping flux, which makes the antenna of the present invention suitable for medical applications.

In one aspect of the present invention, the antenna includes a radiating ring element formed as a spherical sector and having about a one-half wavelength circumference in natural resonance for obtaining uniform current distribution and enhancing its gain relative to its size. The diameter of the radiating ring element is about twice its height in one aspect of the present invention. The spherical sector also comprises a one-third pi sector of a sphere in a suitable embodiment. The radiating ring element can also include a capacitive element formed therein for forcing the radiating ring element to resonance. In one aspect of the present invention a gap is formed within the radiating ring element and is operative as a capacitive element. A capacitor could be mounted within the gap to aid in establishing the desired capacitance for resonance.

In yet another aspect of the present invention, a variometer feeds the radiating ring element and is operative for varying the feed impedance. The variometer includes a primary radiating element positioned within the radiating ring element which acts as a secondary. Thus, the primary radiating element has a near field coupling for exciting the radiating ring element. In one aspect of the present invention, the variometer is formed as a rotatable radiating ring element. A controller and drive is operative with the rotatable radiating ring element and controls its rotation relative to the larger, radiating ring element for changing the feed impedance in a predetermined manner.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The present invention is a small, spherical ring antenna that has a uniform current distribution and enhanced gain relative to its size. The antenna of the present invention is an improvement over prior art antennas that were manufactured to be compatible with miniaturized electronics while attempting to provide high gain for their small size by using basic Maxwell and Wheeler coil designs, which suffered from coil shading, proximity effects, Eddy currents, escaping flux, and a lack of current distribution. The present invention is an improvement over these prior art Maxwell spherical inductors and Wheeler coils, and uses a radiating ring element formed as a spherical sector having a maximum surface and minimum volume. It can have a forced resonance while maintaining high efficiency, and allows a variometer feed for varying the feed impedance. It has uniform current distribution with no Eddy currents and no proximity effects.

Nature, in the present envelope of physics, provides perfect insulators and imperfect conductors at room temperature. Vacuum is a perfect dielectric, while our best 20 degree C. conductor, silver, is an imperfect conductor. The Spherical Ring Antenna is optimum, in that forced resonance, for electrically small operation, is obtainable by efficient vacuum dielectric capacitor loading, with the antenna structure forming the necessary inductor, in the optimum spherical ring geometry.

The three smallest antennas are: the one dimensional half wave dipole, implemented as a thin filament of conductive wire, the two dimensional annular ring, implemented as a thin flat ring, and the three dimensional Spherical Ring Antenna, implemented as a spherical ring. These provide the smallest volume antenna, the smallest area antenna, and the smallest length antenna, respectively.

Figure 1:
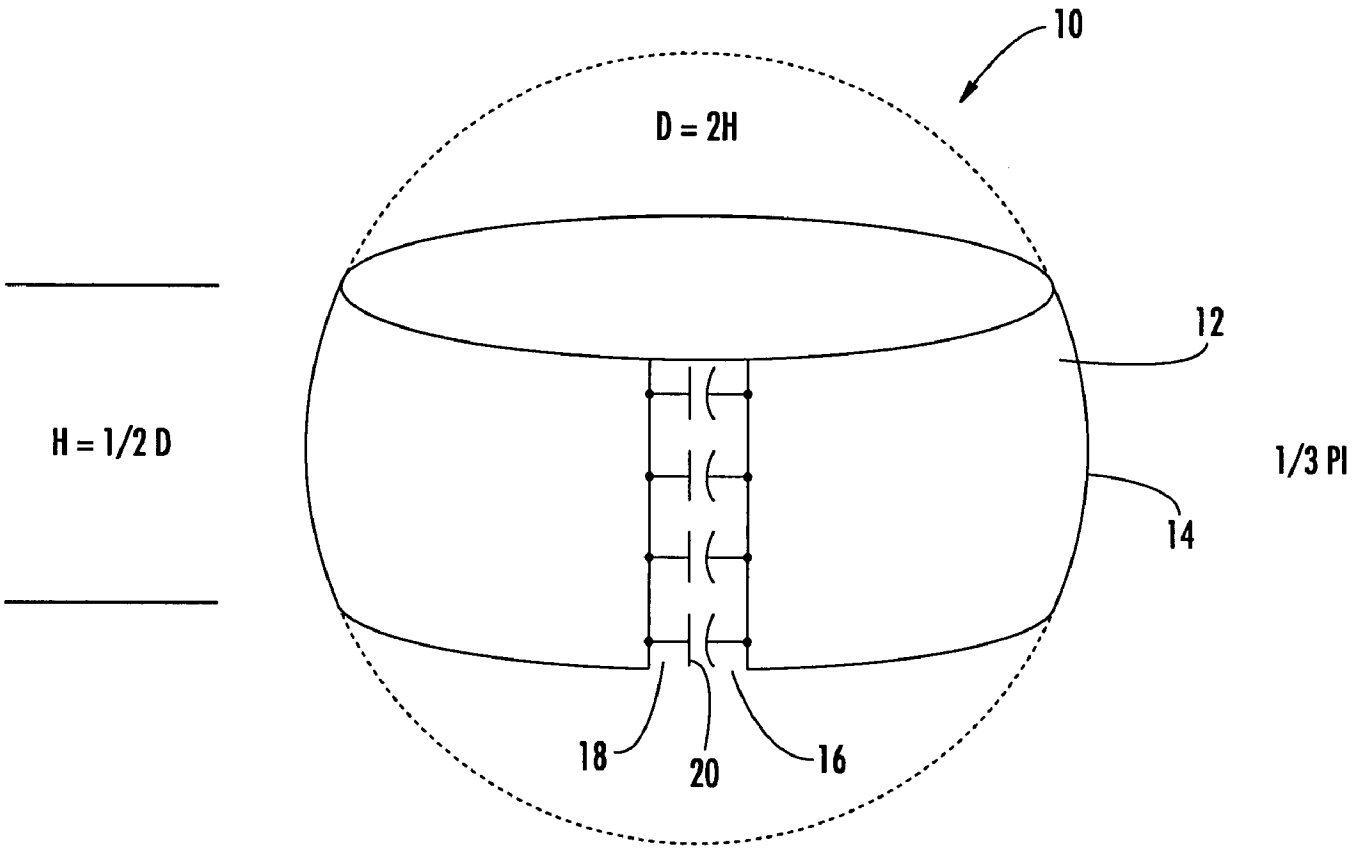
FIG. 1 is a fragmentary view of one example of the spherical antenna of the present invention and showing basic dimensions relative to each other.

FIG. 1 is a fragmentary drawing of the antenna 10 of the present invention, and shows a radiating ring element 12 formed as a spherical sector having about a one-half wavelength circumference in natural resonance for obtaining a uniform current distribution and enhancing its gain relative to its size. In one aspect of the present invention, the diameter of the radiating ring element 12 is about twice its height. The spherical sector comprises a one-third pi sector of a sphere along its outer surface 14 as illustrated.

In yet another aspect of the present invention, the radiating ring element 12 includes a capacitive element 16 as part of its ring structure and preferably located where the antenna is fed, for forcing the radiating ring element to resonance. This antenna design is advantageous and reduces its size, while maintaining resonance. It overcomes the drawback of having an antenna configuration where its actual antenna diameter is a one-half wavelength dimension. At low frequencies these dimensions are very large and unsuitable for many modern day communication applications, where small antenna size is paramount. In those lower frequency ranges with longer wavelengths, an antenna diameter for a loop or ring of one-half wavelength could possibly be unacceptable, such as in submarines and other low frequency applications.

In another aspect of the present invention, the capacitive element 16 could be formed as a gap 18 (shown highly enlarged and exaggerated in FIG. 1) within the structure of the radiating ring element 12 to form a loading gap. This gap is small to impart the desired capacitance at this preferred feed point area and establish the desired resonance. The gap 18 could include capacitors 20 to aid in establishing the desired resonance, or, if the gap is carefully designed and formed as a very small but precise gap, capacitors 20 may not have to be used. The spherical ring element can also be filled with a magneto-dielectric loading material having a relative permeability equal to the relative permittivity.

Figure 2:
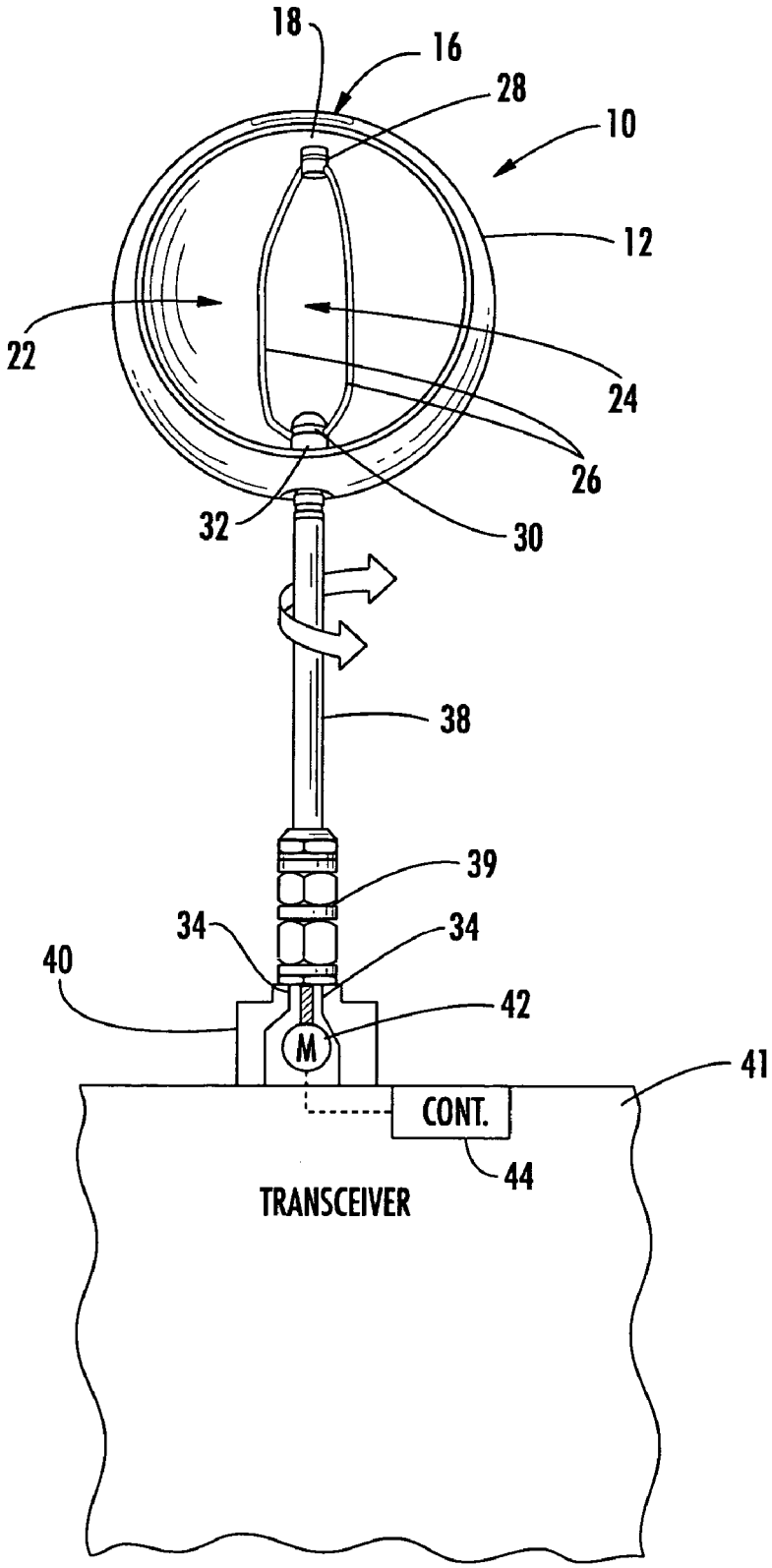
FIG. 2 is a fragmentary and partial isometric view of the spherical antenna as part of a transceiver, and using a variometer and connected to a feed line, drive motor and controller.

Referring now to FIG. 2, a more detailed view of the antenna of the present invention is illustrated with associated components. A variometer 22 feeds the radiating ring element 12 and is operative for varying the feed impedance. The variometer 22, in one non-limiting example, includes a smaller, primary radiating ring element 24 positioned within the larger radiating ring element 12. This smaller, primary radiating ring element 24 has a near field coupling with the radiating ring element 12 for exciting the radiating ring element 12.

In one non-limiting example of the present invention, the variometer 22 is formed as a rotatable radiating ring element 24 a turn of thick coil wire 26 and connected for rotation at its top end 28 to the loading gap 18 formed by any capacitors and/or ring gap, and at its lower end 30 to a rotatable mounting assembly 32. A feed line 34, for example, a coaxial line, extends from the lower end 30 through a feed channel or coaxial feed tube 38 shown in FIG. 2. An appropriate coaxial connector assembly 39 allows connection of the antenna to a antenna support or other antenna device mount 40, for example, on a transceiver 41. A stepper motor 42 or other drive can be operatively connected to the variometer 22 for turning the rotatable radiating ring element 24. A microcontroller 44 can be operatively connected to the stepper motor 42 for controlling rotation of the rotatable radiating ring element 24 and changing the feed impedance in a predetermined manner. The feed impedance is established by the position of the inner spherical and rotatable radiating ring element 24 relative to the radiating ring element 12.

The variometer 22 is important for changing the feed impedance, allowing connection of this small antenna to different types of connectors or feed lines, for example, 50 ohm coaxial cable. The variometer 22 generates an operating resistance or feed impedance as desired. It is also possible to add a third spherical ring (not shown), which could form a capacitor to the smaller, primary radiating ring element 24. The overall system could become a fractal or spherical ring antenna assembly.

A non-limiting example of the spherical ring antenna of the present invention is now described. A silver spherical ring antenna of 1/22 wavelengths in diameter can operate at a gain of unity, which is an efficiency of 58 percent and a numerical gain of 0.0 dBi. This is for a spherical ring antenna implemented in silver at 1000 MHz. The directivity of this antenna is 1.76 dB, or 1.5 as a dimensionless coefficient. This is the fundamental form of the antenna as a transducer of electromagnetic waves, in that a sphere provides the greatest surface area for least volume, which is the optimum geometry for an antenna of minimum length.

This very small and efficient spherical antenna design of the present invention can be used in many different wireless products, including radio frequency communications and broadcasts including common consumer electronic applications, such as cell phones, pagers, wide local area network cards, GSM/land mobile communications, TV antennas, and high frequency radio systems. It can also be used in exotic applications, including VLF, GWEN, EMP weapons, ID tags, land mines and medical devices. Because the antenna of the present invention also has no Eddy currents and proximity effects (having, in effect, only one turn of coil) it has no escaping flux and is very practical in medical applications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. An antenna comprising:

a radiating spherically configured ring element formed as a substantially solid spherical sector having about a one-half wavelength circumference in natural resonance for obtaining uniform current distribution and enhancing the gain relative to the size of the antenna.

2. An antenna according to claim 1 wherein the diameter of the radiating ring element is about twice its height.

3. An antenna according to claim 1 wherein the spherical sector comprises a one-third pi sector of a sphere.

4. An antenna according to claim 1 wherein said radiating ring element includes a capacitive element formed therein for forcing the radiating ring element to resonance.

5. An antenna according to claim 4 wherein said radiating ring element has a gap formed therein and operative as said capacitive element.

6. An antenna according to claim 5, and further comprising a capacitor mounted within the gap.

7. An antenna according to claim 1, and further comprising a variometer that feeds the radiating ring element and operative for varying the feed impedance.

8. An antenna according to claim 7 wherein said variometer comprises a radiating element positioned within the radiating ring element and having a near field coupling thereto for exciting the radiating ring element.

9. An antenna according to claim 8 wherein said variometer further comprises a rotatable radiating ring element.

10. An antenna according to claim 9 and further comprising a controller and drive operative with the rotatable radiating ring element for controlling its rotation and changing the feed impedance in a predetermined manner.

11. An antenna comprising:

a radiating spherically configured ring element formed as a substantially solid spherical sector and having a capacitive element formed therein for forcing the radiating ring element to resonance and a circumference that enhances the gain relative to the size of the antenna.

12. An antenna according to claim 11 wherein the diameter of the radiating ring element is about twice its height.

13. An antenna according to claim 11 wherein the spherical sector comprises a one-third pi sector of a sphere.

14. An antenna according to claim 11 wherein said radiating ring element has a gap formed therein operative as said capacitive element.

15. An antenna according to claim 11, and further comprising a capacitor mounted within the gap.

16. An antenna according to claim 11, and further comprising a variometer that feeds the radiating ring element at the capacitive element and operative for varying the feed impedance.

17. An antenna according to claim 16 wherein said variometer comprises a radiating element positioned within the radiating ring element and having a near field coupling thereto for exciting the radiating ring element.

18. An antenna according to claim 17 wherein said variometer further comprises a rotatable radiating ring element.

19. An antenna according to claim 18, and further comprising a controller and drive operative with the rotatable radiating ring element for controlling its rotation and changing the impedance feeding the radiating ring element in predetermined manner.

20. An antenna comprising:

a spherically configured radiating ring element formed as a spherical sector and having a circumference dimensioned at a natural resonance for obtaining uniform current distribution and enhancing the gain relative to the size of the antenna; and a variometer feeding the radiating ring element and operative for varying the feed impedance.

21. An antenna according to claim 20 wherein said variometer comprises a radiating element positioned within the radiating ring element and having a near field coupling thereto for exciting the radiating ring element.

22. An antenna according to claim 21 wherein said variometer further comprises a rotatable radiating ring element.

23. An antenna according to claim 22 and further comprising a controller and drive operative with the rotatable radiating ring element for controlling its rotation and changing the impedance feeding the radiating ring element in predetermined manner.

24. An antenna according to claim 20 wherein the diameter of the radiating ring element is about twice its height.

25. An antenna according to claim 20 wherein the spherical sector comprises a one-third pi sector of a sphere.

26. An antenna according to claim 20 wherein said radiating ring element includes a capacitive element formed therein for forcing the radiating ring element to resonance.

27. An antenna according to claim 26 wherein said radiating ring element has a gap forming the capacitive element.

28. An antenna according to claim 27 and further comprising a capacitor mounted within the gap.

29. An antenna according to claim 28 wherein the spherical ring element is filled with a magneto-dielectric loading material having a relative permeability equal to the relative permittivity.

* * * * *